US005088609A

United States Patent [19]

Fryc

[11] Patent Number: 5,088,609

[45] Date of Patent: Feb. 18, 1992

[54] APPARATUS FOR SUPPORTING WORKPIECES OF DIFFERENT SIZES AND CONFIGURATIONS

[75] Inventor: Oldrich Fryc, Renton, Wash.

[73] Assignee: The Boeing Company, Seattle, Wash.

[21] Appl. No.: 482,431

[22] Filed: Feb. 20, 1990

[51] Int. Cl.[5] ..... A47F 5/08

[52] U.S. Cl. ..... 211/117; 204/297 W; 248/231.8; 248/316.7; 118/503

[58] Field of Search ..... 24/499, 458, 27, 67.11, 24/67.9, 546, 555; 118/500, 503; 211/106, 119, 181, 117, 208, 70.6, 204, 123, 118, 192, 105.1; 204/297 W, 297 R; 248/327, 340, 309.1, 316.7, 231.8

[56] References Cited

U.S. PATENT DOCUMENTS

| | | | |
|---|---|---|---|
| 536,379 | 3/1895 | Ervey | 248/231.8 |
| 2,541,597 | 2/1951 | Midling | 204/297 W |
| 4,217,853 | 8/1980 | Davitz | 118/500 |
| 4,591,420 | 5/1986 | Horn | 204/297 W |
| 4,615,785 | 10/1986 | Palide | 204/297 W |
| 4,679,526 | 7/1987 | Dziedzic | 118/503 |

FOREIGN PATENT DOCUMENTS

| | | | |
|---|---|---|---|
| 3635830 | 5/1988 | Netherlands | 211/69.8 |

*Primary Examiner*—Carl D. Friedman
*Assistant Examiner*—Korie Chan
*Attorney, Agent, or Firm*—R. H. Sproule; B. A. Donahue

[57] ABSTRACT

Apparatus for supporting parts to allow the parts to manipulated such as for application of protective coatings and paint. The apparatus includes a support rack and at least one flexible wire-like clamp. In an exemplary embodiment, the clamp includes an engaging end which support the part configured as a pair of helical rings which support the part against an edge of the rack. The opposite end of the clamp includes a pair of opposing rings which engage opposing faces of the support rack. In some embodiments, the clamp may be rotated to adjust the distance between the engaging rings and the support rack edge in order to accomodate parts of different sizes and configurations. The clamp includes a finger which is inserted within a selected one of a plurality of holes in the support rack so as to prevent unwanted rotation of the clamp and thereby maintain it in a selected position.

11 Claims, 5 Drawing Sheets

T
C
22
20
20
P
P 42
50
52
56
40
48
58
66
60
68
64
72
70
74
76
26

78
20
56
52
26
36
34
P
30
28
40

68'
48'
76'
74'
80
84
82
56
52
28
58
48
64

56
52
42
50

48
58
68
72
74
66
70
60
64
76

APPARATUS FOR SUPPORTING WORKPIECES OF DIFFERENT SIZES AND CONFIGURATIONS

TECHNICAL FIELD

The present invention pertains to an adjustable clamping device for supporting workpieces, such as aircraft parts, of different sizes and configurations to allow various operations, such as cleaning, plating and painting, to be performed on the workpieces.

BACKGROUND OF THE INVENTION

For the fabrication of mechanical parts it is desirable to use a device for supporting the parts during the fabrication process. For example, in the aircraft industry it is necessary for many of the aircraft parts to be cleaned, coated with an anticorrosive substance, and then primed and painted. One method of accomplishing this procedure is to insert the parts first in a liquid bath containing the cleaning solution, then in another liquid bath containing a plating solution, and then into a hot water rinse bath. The part is then dried before applying a primer coat and paint.

In order to properly support parts of various sizes and shapes while in the baths as well as during the priming and painting processes, it is necessary that the parts be held securely but with a minimum amount of contact so that their surfaces are not masked. Furthermore, it may be desirable to subject the parts to an anodized plating process in which electrical contact must be made with the parts.

Conventionally, parts have been supported on racks having bendable tabs which are bent into position to hold the parts, and then bent back out of position so that the parts can be removed from the racks. This procedure introduced several problems including unwanted separation of the tabs from the racks due to metal fatigue. In addition, unsatisfactory masking of the parts by the racks prevented proper coating by the liquid solutions and paint. Furthermore, the racks tended to retain small amounts of the solution when removed from the baths so that when the racks were placed in a different bath, this bath solution became contaminated.

Other conventional racks have been disclosed. For example, in U.S. Pat. No. 4,615,785 by Pulido there is disclosed a clip for securing a workpiece to a bar for suspending the workpiece in a liquid bath. Furthermore, in U.S. Pat. No. 4,679,526 by Dziedzic there is disclosed a holder for a workpiece wherein the holder is made from a single piece of springy wire which is attached to a carrier for transporting the workpiece along a predetermined path.

SUMMARY OF THE INVENTION

The present invention pertains to apparatus for supporting a workpiece, and more specifically to apparatus for clamping and holding parts for storing or handling the parts during a fabrication process which may include degreasing, plating, painting and drying operations. The apparatus includes a support rack as well as an element for engaging the workpiece so as to support the workpiece between the support rack and the engaging element. The workpiece is supported in a manner that a force applied by the engaging element causes the workpiece to be held between the support rack and the engaging element. The engaging element includes (1) an end for contacting the workpiece, and (2) an end for grasping the support rack so as to position the contacting end at a selected distance from the support rack so as to hold the workpiece.

BRIEF DESCRIPTION OF THE DRAWINGS

The present invention will be discussed in greater detail in the following detailed description in conjunction with the attached drawings, in which.

DETAILED DESCRIPTION

The present invention pertains to clamping device which is adjustable for holding parts of various sizes and configurations. In the following detailed description the clamping device will be described for use in clamping parts to allow the parts to be coated with various substances. However, the present invention may be used for any application where it is desirable that a part be held by mechanical means.

Figure 1:
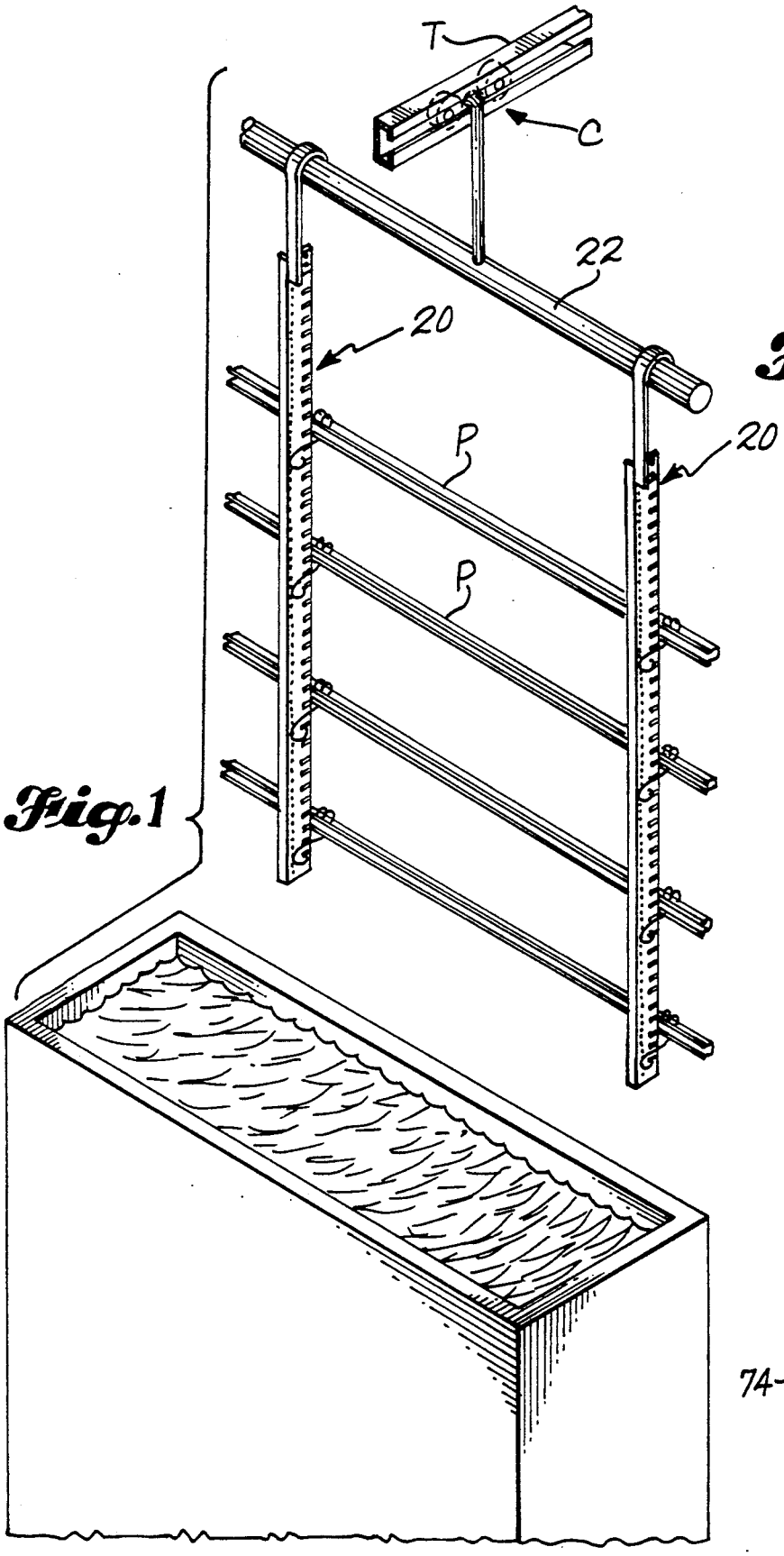
FIG. 1 is an isometric view of a system for supporting parts for insertion into a liquid bath wherein the system includes an exemplary support apparatus of the present invention.

Referring first to FIG. 1 there is shown an exemplary embodiment which includes a pair of unique adjustable clamping racks each indicated by the number 20 for holding a number of parts P. As shown in FIG. 1, the racks 20 are supported in a vertical manner on a horizontal bar 22. Supporting the bar 22 is a conventional overhead mobile crane C which is supported on a overhead track T. In operation, the crane elevates the racks 20, positions the racks over a liquid bath B, and then lowers the racks 20 into the bath so that the parts P are submerged in the liquid. After a selected time has elapsed, the racks are elevated by the crane and moved to a different location where further operations are performed on the parts. Although there is shown here a pair of racks 20 for holding parts P which have large lengthwise dimensions, a single rack 20 may suffice when the parts have shorter lengthwise dimensions.

Figure 2:
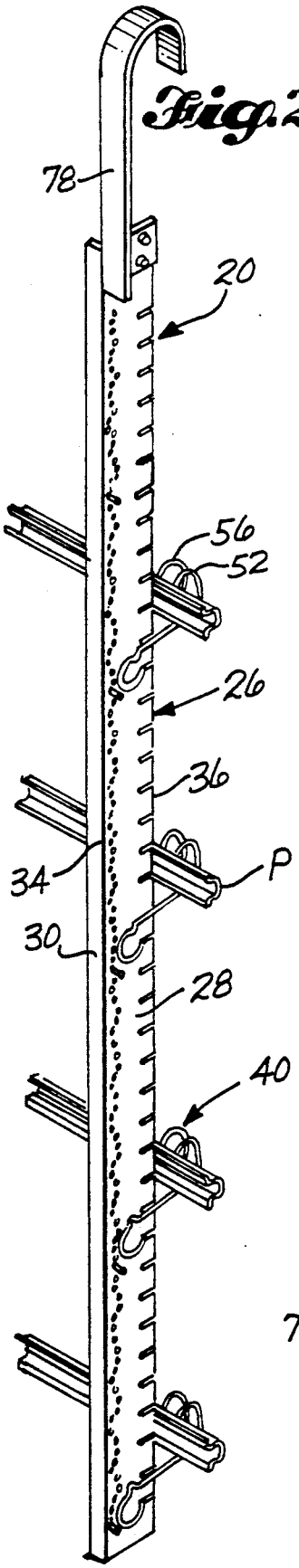
FIG. 2 is an isometric view of the exemplary embodiment shown in FIG. 1.
Figure 6:
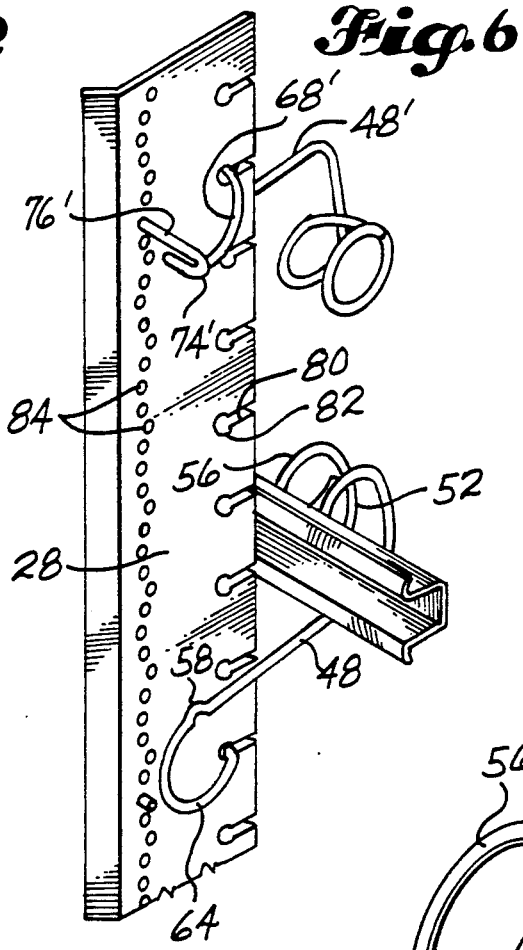
FIG. 6 is a partial isometric view of the exemplary embodiment shown in FIG. 2.

Having described an exemplary environment where the clamping racks 20 may be used, attention now will be turned to the details of these racks. In FIG. 2 there is shown the clamping rack 20 which includes an elongate vertical support column indicated at having a L-shaped cross-section (to provide additional lengthwise support) formed by a wider elongate flange element 28 having first and second sides and a narrower elongate flange element 30. The support column 26 further includes a left corner 34 where the flanges 28, 30 meet and a right edge 36. Connected to the support column 26 are a number of removable wire clamps indicated at 40 which support the parts P by pressing the parts against the right edge 36 of the support column 26. The right edge 36 has a rounded configuration where it contacts the part P so as to minimize the amount of contact with the part.

Figure 3:
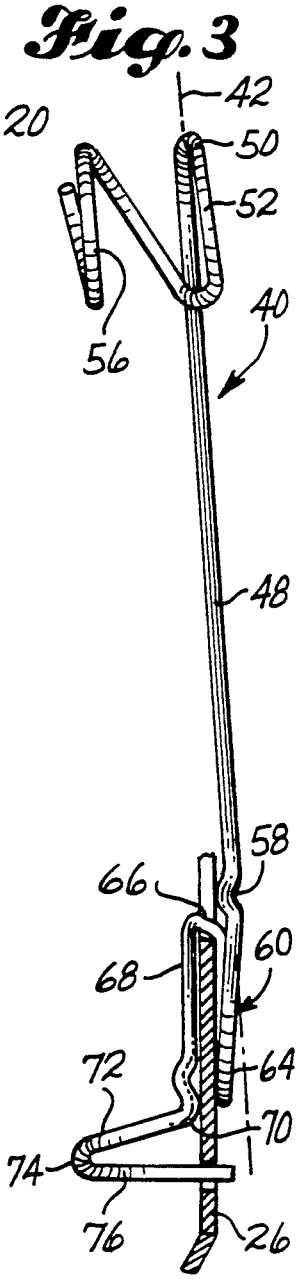
FIG. 3 is an isometric view of a clamping element which forms a portion of the exemplary embodiment shown in FIG. 2.
Figure 4:
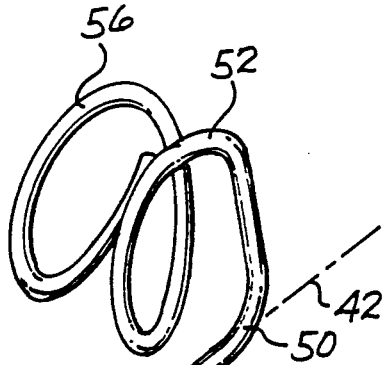
FIG. 4 is a different isometric view of the clamping element shown in FIG. 3.
Figure 4:
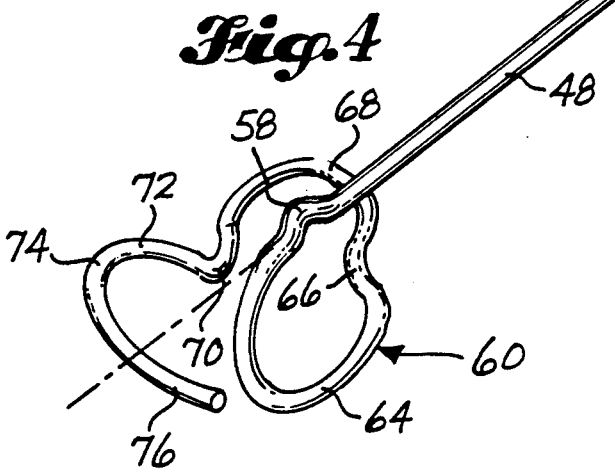

Referring now to FIGS. 3 and 4, the clamp 40 will be described with reference to an imaginary plane which is perpendicular to the plane of FIG. 3 wherein the edge of the imaginary plane is shown by a dashed line designated by a number 42. Lying in the plane 42 is a main segment 48 of the clamp which is integrally connected to a ninety degree curved upper end 50 which also lies in the plane 42 and which is integrally connected to a first helical ring 52. Ring 52 lies in the plane 42 until completion of about one half a circle, whereupon ring 52 curves gradually to the left of the plane 42 (FIG. 3) for a remaining half a circle where it is integrally connected to a second ring 56 which lies in a second imaginary plane (not shown) further to the left of but substantially parallel to plane 42. The purpose of the helical rings 52, 56 is for engaging the parts P in a manner to be discussed later.

Returning to the main segment 48 (FIG. 3) and proceeding in a downward direction, there is a small leftward extending bump 58 at the lower end of the main segment 48 (when viewing FIG. 3) which displaces the main segment 48 away from the right face of the support column 26. This allows the area between the support column 26 and the main segment 48 of the clamp to be drained of solution, paint or the like thereby reducing the possibility of contamination when the support rack is used in later processes.

Integrally connected to the lower end of the bump 58 in FIG. 3 is a ring 60 (shown best in FIG. 4) which includes a first arcuate segment 64 that is angled slightly from the plane 42 (FIG. 3) for about half a circle, with the remaining portion of the ring 60 being displaced leftward of the plane 42 a short distance by means of a displacement segment 66. The ring 60 then completes the remaining half of the circle in a second imaginary plane (not shown) which is to the left of and parallel to the plane 42 (FIG. 3) thereby forming a second arcuate segment 68. At this location, the arcuate segment 68 has a slight rightward extending bump 70. From the bump 70, the clamp extends leftward in a direction perpendicular to the plane 42 by means of a linear segment 72 and then it reverses direction by means of a U-shaped bend 74 which is large enough to permit insertion of a human finger. The clamp then continues rightward by means of a finger 76 which is perpendicular to the plane 42 and which terminates slightly to the right of the plane 42. As shown in FIG. 3, when the clamp is installed on the support column, the wide flange portion 28 of the column is "grasped" between the right segment 64 and the left bump 70 of the ring 60. Furthermore, the bump 70 displaces the left segment 68 from the left face of the support column flange 28 to allow for draining of contaminants in the same manner as bump 58 (described previously) displaced segment 48.

Before describing the attachment of the clamp 20 to the support column 26, a detailed description of the support column will be provided. As shown in FIG. 2, connected to the upper end of the column is an inverted J-shaped hanger 78. The hanger 78 is hung over the complementary shaped bar 22 as shown in FIG. 1. Located along the right edge 36 of the column are a number of horizontal linear slots 80 (FIG. 5) which terminate at their left ends at respective circular slots 82. The slots 80, 82 are sized to receive and support the clamp 40 in the manner shown in FIG. 5. Further support for the clamp is provided by a plurality of holes 84 which extend through the wide flange 28 and which are sized to receive the clamp support finger 76 therein. The holes 84 are located in separate groups **84*a* through 84*i*, wherein each group of holes 84 is associated with a particular circular slot 82. More specifically, the upper group of holes 84*a* is located along an arc at equidistant locations from the upper slot 82*a***. This permits the clamp to be adjusted to hold different sized parts in the manner to be described below.

That is, the clamp 40 may be attached to the support column in a number of different positions. For example, as shown in FIG. 2, the clamp is attached so that the engaging rings 52, 56 are oriented in an upward direction. In this orientation, the clamp is installed so that the segment 64 (FIG. 5) of the ring 60 is adjacent to a front face 86 of the support column flange 28, and the other segment 68 of the ring 60 is adjacent to the rear face (not shown) of the support column flange 28. This is accomplished by inserting the displacement segment 66 through the horizontal slot 80 and into the circular end slot 82. In addition, the support finger 76 is inserted into one of the holes 84.

Figure 7:
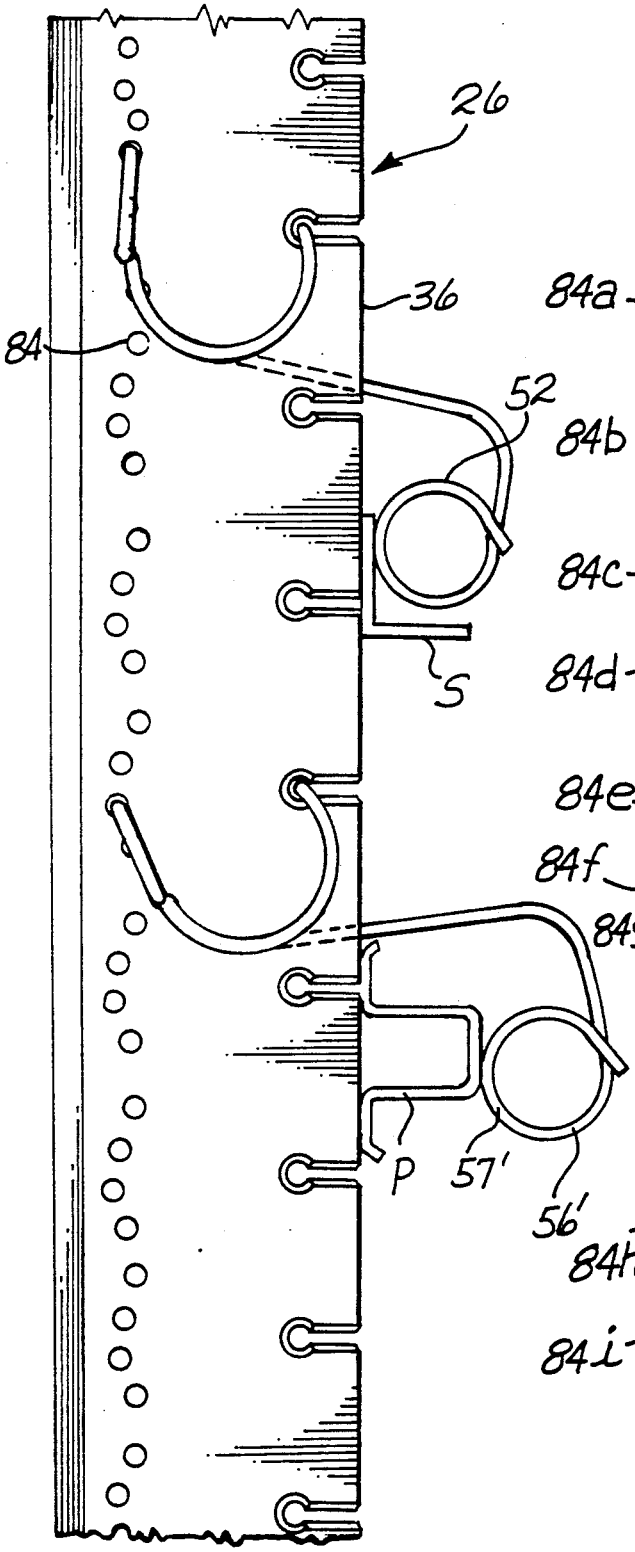
FIG. 7 is a partial side view of the exemplary embodiment shown in FIG. 2.

Once the clamp 40 is installed, it is adjusted as a function of the size and configuration of the part to be supported. For example, a smaller part such as the part S shown in FIG. 7, may require a relatively short distance between the engaging portions of the rings 52, 56 and the engaging edge 36 of the support column. To adjust this distance, an operator grasps the U-shaped bend 74 (FIG. 5) of the clamp, and the clamp finger 76 is pulled out of the hole 84. Accomplishing this, the clamp 40 is rotated inside the end slot 82 until the desired engaging ring-to-support column edge distance is reached whereby the finger 76 is re-inserted within the appropriate hole 84. In the present embodiment, the parts are held solely by the force exerted against the part by the rack and clamp.

It is generally desirable that the clamp 40 be made from a flexible, resilient material. In the exemplary embodiment, the clamp is made from a noncorrosive metal such as titanium. In addition, the titanium is electrically conductive in the event the parts are subjected to an anodizing process.

Figure 5:
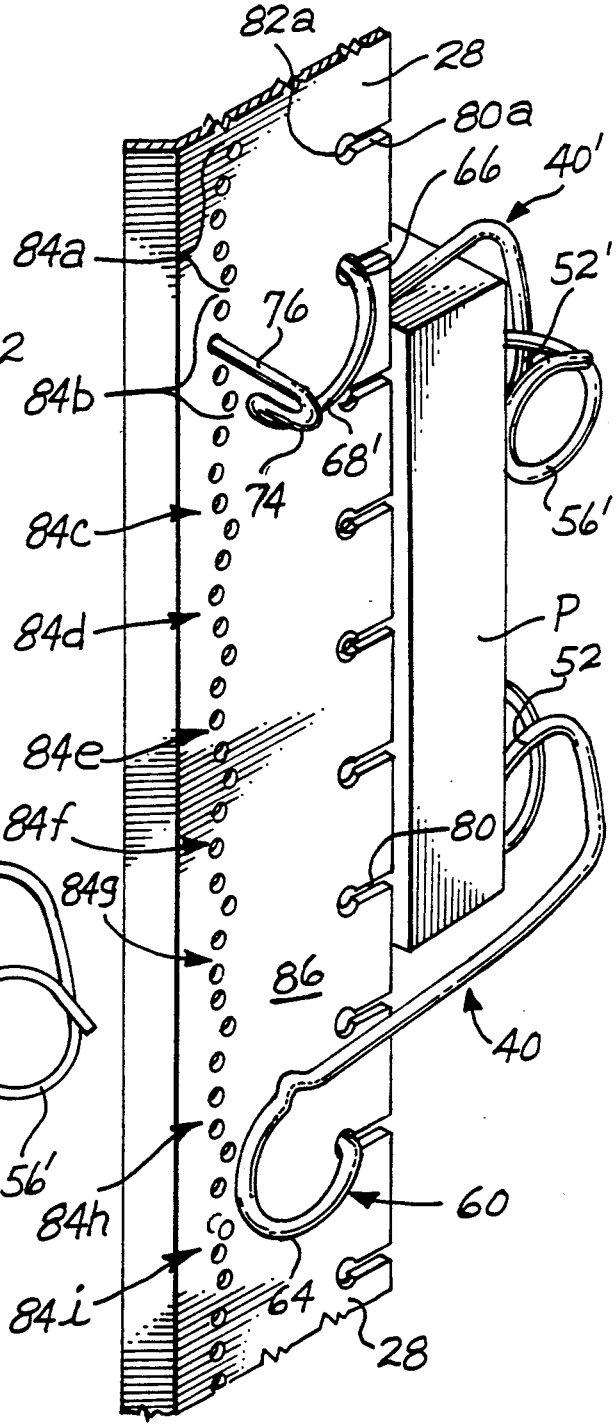
FIG. 5 is an isometric view of a portion of the exemplary embodiment shown in FIG. 2 wherein two clamping elements are used to support a part.

When supporting very large parts, it may be desirable to use two clamps as shown in FIG. 5. In order to accomplish this, a second clamp 40', which is identical to the clamp 40, is installed above the clamp 40 so that the engaging rings 52',56' of the clamp 40' are oriented in a downward direction. This is accomplished by installing the clamp 40' in the manner described previously, except that the segment 68' of the ring 60' is located adjacent to the front face of the support column flange 28 and the other segment (not shown) of the ring 60' is located adjacent to the rear face of the support column flange 28.

Figure 8:
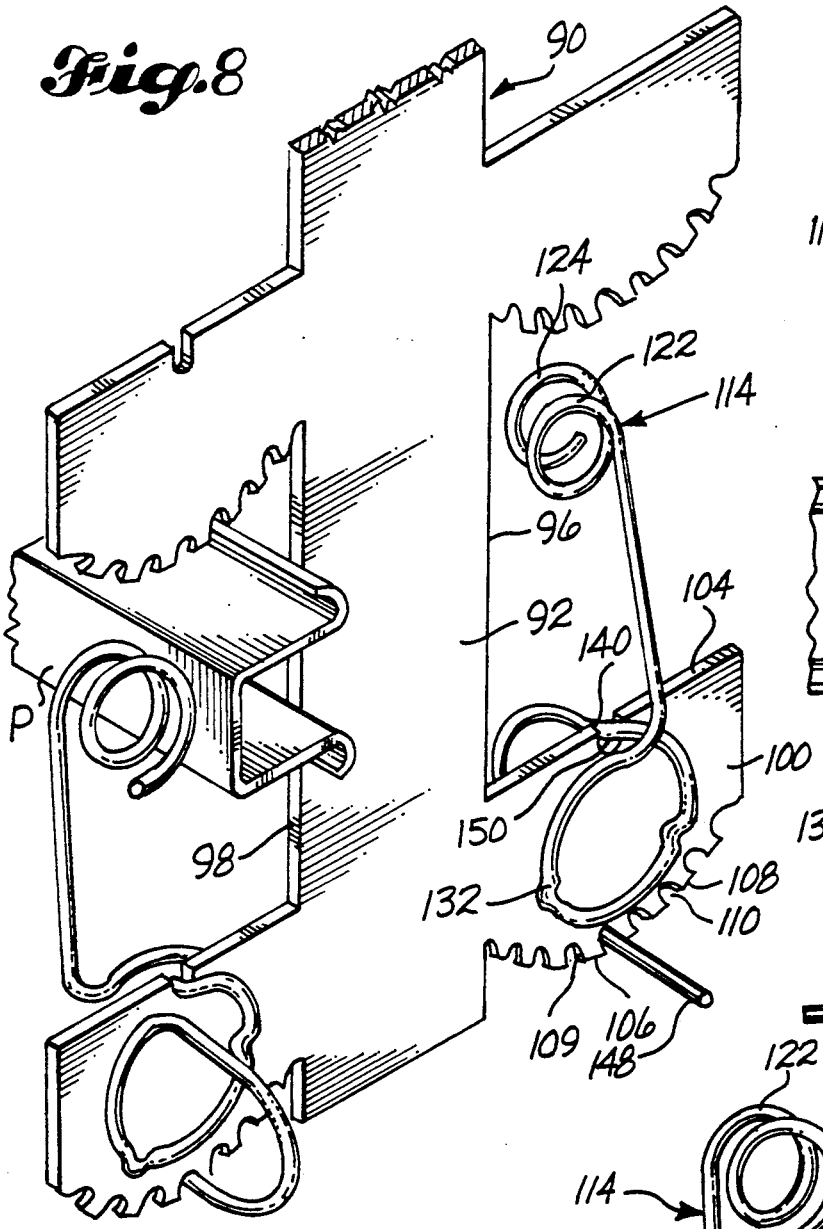
FIG. 8 is an isometric view of another exemplary support apparatus of the present invention.

Referring now to FIG. 8, there is shown a second exemplary embodiment of the present invention. The present embodiment includes a support column, indicated at 90. The support column 90 includes a main vertical segment 92 which has a right vertical edge 96 and a left vertical edge 98. Integrally connected to the main segment 92 and located at right angles thereto are a number of tabs 100 each one having an upper horizontal edge 104 and a lower edge 106 having a generally convex shape. The lower edge 106 has a number of downwardly extending teeth 108 which are separated by intermediate upwardly extending valleys 110. The teeth 108 have parallel sides 109 which curve away from the edge 96 to form a ratchet-like device. This prevents unwanted clockwise movement of the clamp and securely holds the part in place.

Figure 9:
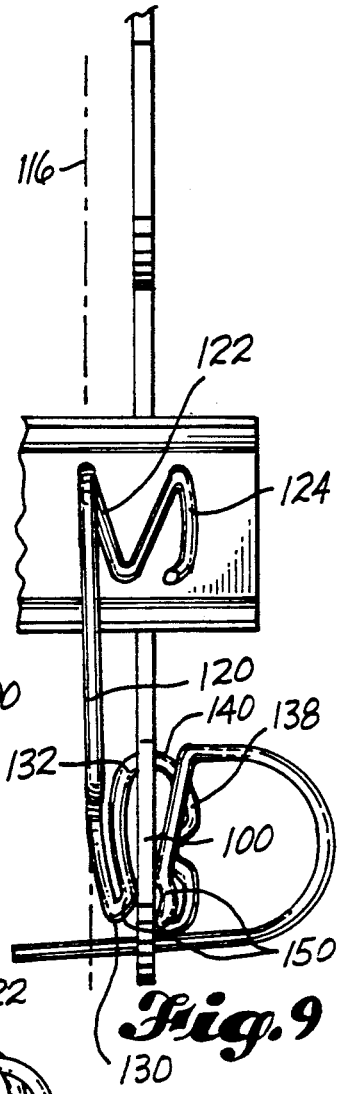
FIG. 9 is an end view of the exemplary embodiment shown in FIG. 8.
Figure 10:
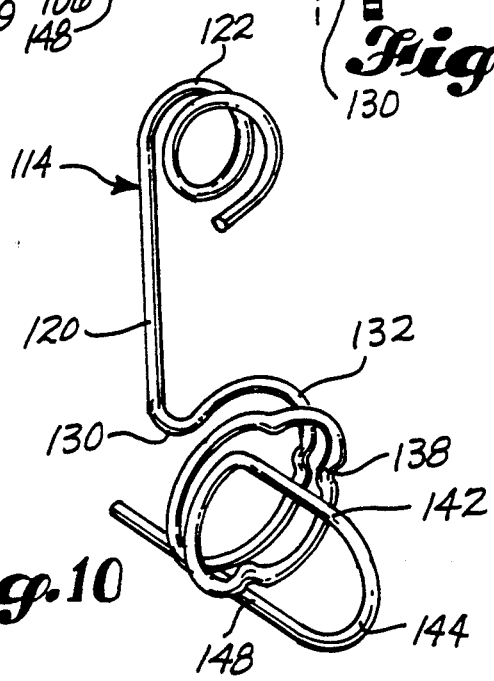
FIG. 10 is an isometric view of a clamping element which forms a portion of the exemplary embodiment shown in FIG. 8.

In order to support a part P, there is attached to the support rack 90 a removable clamp 114 which is more clearly shown in FIGS. 9 and 10. The clamp 114 will be described with reference to an imaginary plane which is perpendicular to the plane of FIG. 9 wherein the edge of the imaginary plane is shown by a dashed line designed by a number 116. Lying in the plane 116 is a main elongate segment 120 of the clamp. Integrally connected to the upper end of the main segment 120 (when viewing FIG. 9) is a helical ring 122 which begins in the plane 116, but which terminates to the right of the plane 116 (when viewing FIG. 9). The ring 122 is integrally connected to another helical ring 124 which curves to the right of the helical ring 122. As shown in FIG. 8, the helical rings 122, 124 engage the part P so that the pressure exerted by the rings 122, 124 support the part against the rounded vertical edges 96, 98 of the support rack. In a preferred embodiment, the weight of part P rests on the upper surface 104 of the tab 100.

In order to attach the clamp 114 to the rack 90, there is integrally connected to the lower end of the clamp's main segment 120 (FIG. 9) a ninety degree bended segment 130. Curving rightward from the end of the bended segement 130 is a first ring 132 which lies slightly to the right of the plane 116 and which engages the left face of the tab 100. In order to engage the right face of tab 100, there is located adjacent to the first ring 132 a second ring 138 which is joined to the lower ring 132 by a short displacement segment 140. The second ring 138 lies substantially in a second imaginary plane (not shown) which is parallel to the plane 116. At the 360 degree terminus of the upper ring 138 (FIG. 10), there is a linear segment 142 (FIG. 10) which extends rightward in a manner perpendicular to the plane 116 and which terminates at a U-shaped bend 144. The U-shaped bend 144 is joined at its opposite end by a leftward extending engaging finger 148 which is also perpendicular to the plane 116. Furthermore, in order to displace the rings 132, 138 slightly from the opposing faces of the tab 100, the rings include bumps 150 as best shown in FIG. 9.

Installation of the clamp 114 on the support rack requires the engaging rings 122, 124 to be oriented in an upward direction (FIG. 8). The clamp is inserted over the right tab 100 so that the ring 132 is next to the front face of the tab 100, and the ring 138 is next to the rear face (not shown) of the tab. The displacement segment 140 is inserted within a vertical slot 150 in the upper edge 104 of the tab 100 in a manner to allow the clamp to pivot therewithin. Adjustment of the position of the rings 122, 124 relative to the edge 96, which is dependent upon the size of the part P, is maintained by engagement of the finger 148 in a selected valley 110.

Figure 11:
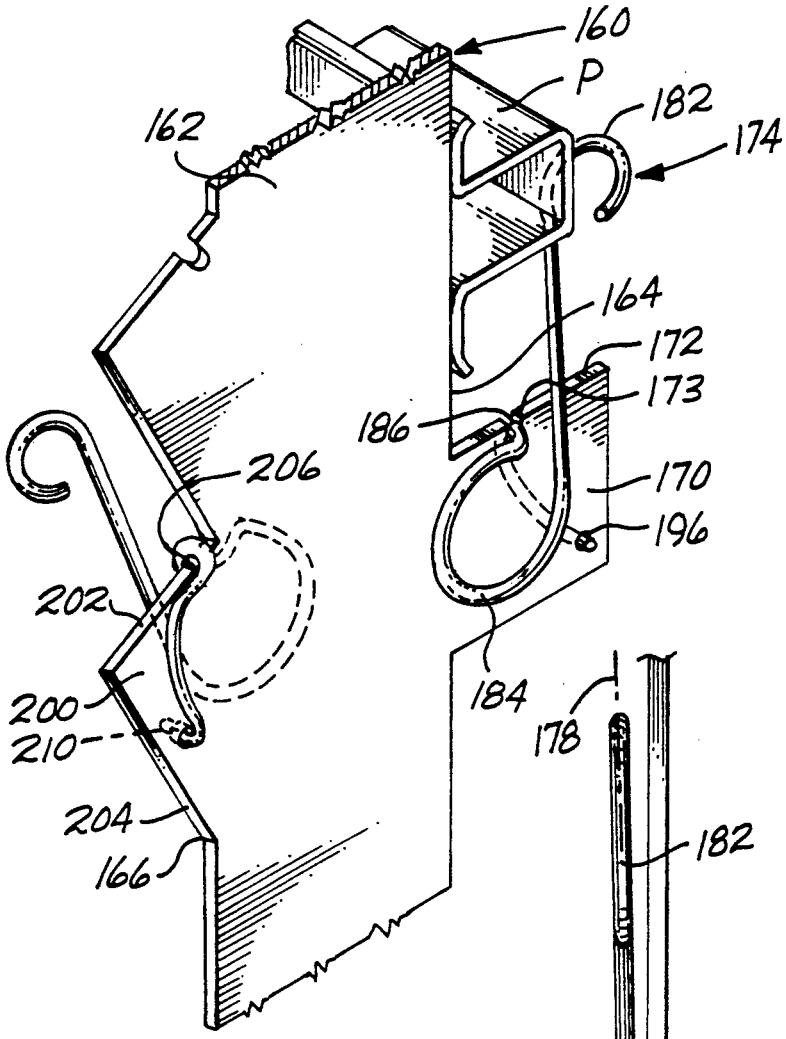
FIG. 11 is a isometric view of a third exemplary support apparatus of the present invention.

Referring now to FIG. 11, there is shown a third exemplary embodiment of the present invention. The present embodiment includes a support rack indicated at 160 having a main vertical segment 162. The main segment 162 includes a right vertical edge 164 and a left sawtooth edge 166. Extending from the right edge 164 is a rectangular tab 170 having an upper horizontal edge 172 with a vertical slot 173 for supporting a clamp indicated at 174.

Figure 13:
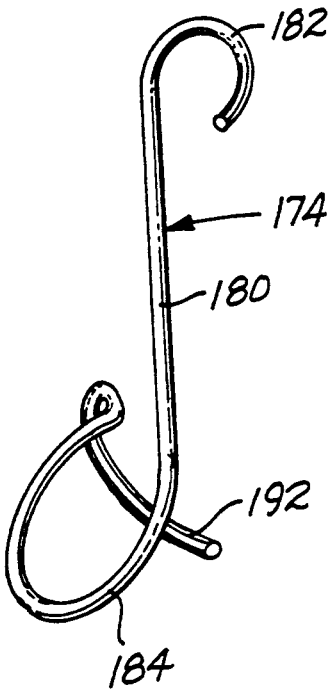
FIG. 13 is an isometric view of an exemplary clamping element which forms a portion of the exemplary embodiment shown in FIG. 11.
Figure 12:
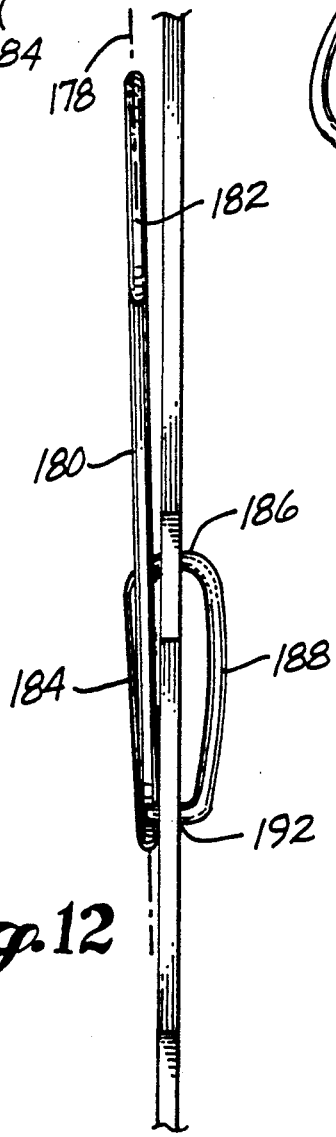
FIG. 12 is an end view of the exemplary embodiment shown in FIG. 11.

Referring now to FIGS. 12 and 13, the clamp 174 will be described with reference to an imaginary plane which is perpendicular to the plane of FIG. 12 wherein the end of the imaginary plane is shown by a dashed line designated by a number 178. Lying in the plane 178 is a main elongate segment 180 of the clamp to which there is attached at the clamp's upper end a semicircular ring 182 which lies in the plane 178. As shown in FIG. 11, the part P is engaged between the rack edge 164 and the ring 182. In order to install the clamp 174 on the tab 170, the lower end of the clamp includes a ring 184 which lies in the plane 178. The ring 184 is joined by a short displacement segment 186 to a curved segment 188 which lies in an imaginary plane (not shown) which is to the right and parallel to the plane 178 when viewing FIG. 12. The curved segment 188 is integrally joined to a short finger 192 which extends leftward in FIG. 12 in a manner perpendicular to plane 178 and which terminates at a location that is slightly to the left of the plane 178 near the juncture of the main segment 180 and the ring 184.

As shown in FIG. 11, the clamp 174 is installed on the tab 170 so that the tab is held in an interference fit between the ring 184 and the curved segment 188 with the displacement segment 186 inserted in the slot 173. In a preferred embodiment, the part P rests on the upper surface 172 of the tab so that a majority of the weight of the part is supported on the tab. Furthermore, the finger 192 is inserted in a hole 196 located in the lower right corner of the tab 170 (when viewing FIG. 11) in order to hold the clamp in the position shown in FIG. 11.

In order to support the part P in a different manner than that described above, the left edge 166 of the support rack 160 includes a number of triangular tabs 200 each of which includes an upper surface 202 which extends in a downward and leftward direction (when viewing FIG. 11) where it terminates at an apex where it is joined to a lower surface 204 which extends in a downward and rightward direction. Located in the upper surface 202 is a vertical slot 206 for receiving the displacement segment 186 of the clamp 174 therein. In addition, each of the triangular tabs 200 includes a hole 210 extending therethrough for receiving the finger 192 of the clamp. This allows the clamp 174 to be installed on the triangular tabs 200 in the same manner as the clamp was installed over the rectangular tabs 170. In the present embodiment, the triangular tabs 200 have several advantages over the rectangular tabls 170. For instance, the triangular tabs are easier to fabricate than the rectangular tabs. In addition, it is not only easier to insert and remove a part from the triangular tabs, but the triangular configuration of the tabs 200 allows more of these tabs than the rectangular tabs to be installed for the same length of support rack.

What is claimed is:

1. Apparatus for supporting a workpiece, the apparatus comprising:

a. a support member having a first side and a second side, the support member further including an edge surface which is formed by the joining of the first side and the second side; and b. engaging means for engaging the workpiece so as to support the workpiece between the support member and the engaging means in a manner that a force applied by the engaging means against the workpiece causes the workpiece to be supported between the support member and the engaging means, the engaging means including (1) an element for contacting the workpiece, (2) attaching means for attaching the contacting element to the support member so as to position the contacting element at a selected distance from the support member and so as to hold the workpiece between the support member and the contacting element, the attaching means including a first grasping element and a second grasping element which are spaced apart in a manner to engage the support member therebetween at the first and second sides in an interference fit.

2. The apparatus as set forth in claim 1 wherein:

a. the support member further includes an opening in the edge surface; and b. the attaching means further includes an element which joins the first grasping element with the second grasping element in a manner that when the engaging means is attached to the support member, the joining element is lcoated in the opening in the edge surface in order to attach the engaging means to the support member.

3. The apparatus as set forth in claim 2 wherein:

a. the opening is a slot which is formed in the edge and which extends between the first side and the second side;

b. the joining element is sized to fit inside the slot and to be supported on a surface of the support member which forms the slot.

4. The apparatus as set forth in claim 3 wherein:

a. the joining element is positioned in the support member slot for pivotal movement therein in a manner that the engaging means is pivotable about an axis which is co-linear with the joining element so as to selectively adjust the distance between the contacting element and the support member edge.

5. The apparatus as set forth in claim 4 wherein:

a. the support member further includes at least one hole therein; and b. the engaging means further includes a finger element which is removably located in the hole so as to prevent rotation of the engaging means and to support the contacting element at a selected distance from the support member edge.

6. The apparatus as set forth in claim 5 wherein the support member further includes a plurality of holes therein which define an arc of holes about the support member slot for receiving the finger element therein in a manner that the location of the finger in each hole supports the contacting element at a different distance from the support member edge.

7. The apparatus as set forth in claim 6 wherein:

a. the first grasping element and the second grasping element each have an arcuate configuration; and b. the finger element is joined to the second grasping element in a manner that the finger element is substantially perpendicular to the first and second surfaces of the support member when the engaging means is attached to the support member.

8. The apparatus as set forth in claim 7 wherein the engaging means is a single piece of a resilient wire-like material.

9. The apparatus as set forth in claim 1 wherein the engaging means further includes an element which joins the first grasping element with the second grasping element in a manner that the joining element engages the support member to attach the engaging means to the support member.

10. Apparatus for supporting a workpiece, the apparatus comprising:

a. a support member having a first side and a second side, the support member further including an edge surface which is formed by the joining of the first side and the second side, and an opening in the edge surface;

b. engaging means for engaging the workpiece so as to support the workpiece between the support member and the engaging means in a manner that a force applied by the engaging means against the workpiece causes the workpiece to be supproted between the support member and the engaging means; and c. attaching means for attaching the engaging means to the support member so as to position the engaging means at a selected distance from the support member and so as to hold the workpiece between the support member and the engaging means, the attaching means including a first grasping element and a second grasping element which are spaced apart in a manner to engage the support member therebetween at the first and second sides in an interference fit, the attaching means further including an element which joins the first grasping element with the second grasping element in a manner that when the engaging means is attached to the support member, the joining element is lcoated in the opening in the edge surface.

11. Apparatus for supporting a workpiece, the apparatus comprising:

a. a support member having a first side and a second side, the support member further including an edge surface which is formed by the joining of the first side and the second side; and b. engaging means for engaging the workpiece so as to support the workpiece between the support member and the engaging means in a manner that a pressure applied by the engaging means against the workpiece causes the workpiece to be supported between the support member and the engaging means, the engaging means including (1) an element for contacting the workpiece, (2) grasping means for grasping the support member so as to position the contacting element at a selected distance from the support member so as to hold the workpiece between the support member and the engaging element, the grasping means includes a firswt grasping element and a second grasping element which are spaced apart in a manner to grasp the support member at the first and second sides so as to support the engaging means on the support member.

* * * * *